US010203067B2

(12) United States Patent
Strobel

(10) Patent No.: US 10,203,067 B2
(45) Date of Patent: Feb. 12, 2019

(54) AUTOMATIC THERMAL DECOUPLING OF A COLD HEAD

(71) Applicant: Bruker BioSpin GmbH, Rheinstetten (DE)

(72) Inventor: Marco Strobel, Karlsruhe (DE)

(73) Assignee: Bruker BioSpin GmbH, Rheinstetten (DE)

( * ) Notice: Subject to any disclaimer, the term of this patent is extended or adjusted under 35 U.S.C. 154(b) by 468 days.

(21) Appl. No.: 14/849,661

(22) Filed: Sep. 10, 2015

(65) Prior Publication Data

US 2016/0084440 A1 Mar. 24, 2016

(30) Foreign Application Priority Data

Sep. 18, 2014 (DE) ..... 10 2014 218 773

(51) Int. Cl.

| | |
|---|---|
| ***F25B 9/00*** | (2006.01) |
| ***F25B 9/10*** | (2006.01) |
| ***F25B 9/14*** | (2006.01) |
| ***F04B 37/08*** | (2006.01) |
| ***F17C 3/08*** | (2006.01) |
| ***F25D 19/00*** | (2006.01) |

(52) U.S. Cl.

CPC ..... *F17C 3/085* (2013.01); *F25D 19/006* (2013.01)

(58) Field of Classification Search

CPC ..... F25B 9/00; F25B 9/10; F25B 9/14; F25B 2309/1428; F25B 9/002; F25B 9/06; F25B 9/12; F25B 9/145; F17C 2203/0375; F17C 2203/0379; F17C 2203/0383; F17C 2203/0387; F04B 37/08; F04B 37/085; H01F 6/04; H01F 6/06; F25D 19/006; F25J 1/00; F25J 1/0007; F25J 1/0015

See application file for complete search history.

(56) References Cited

U.S. PATENT DOCUMENTS

| | | | | |
|---|---|---|---|---|
| 4,535,595 A | | 8/1985 | Keller | |
| 4,967,564 A | * | 11/1990 | Strasser | F17C 3/085 62/383 |
| 5,235,818 A | | 8/1993 | Horikawa | |

(Continued)

FOREIGN PATENT DOCUMENTS

| | | | |
|---|---|---|---|
| JP | H09287838 | | 4/1997 |
| JP | 2013130336 | | 4/2013 |
| JP | 2013130336 A | * | 7/2013 |

*Primary Examiner* — Frantz Jules
*Assistant Examiner* — Erik Mendoza-Wilkenfe
(74) *Attorney, Agent, or Firm* — Paul Vincent

(57) ABSTRACT

A cryostat has a cooling arm with a first thermal contact surface which can be brought into thermal contact with a second thermal contact surface on an object to be cooled. A hollow volume (2) between the inner side of the neck tube, the cooling arm, and the object is filled with gas and the cooling arm is pressurized by the inner pressure of the gas and also by atmospheric pressure. A contact device brings the first and the second contact surfaces into thermal contact below a threshold gas pressure and moves them away from each other when the threshold pressure has been exceeded such that a gap (13) filled with gas thermally separates the first and second contact surfaces. Operationally safe and fully automatic reduction of the thermal load acting on the object to be cooled is thereby obtained in case the cooling machine fails.

11 Claims, 3 Drawing Sheets

(56) References Cited

U.S. PATENT DOCUMENTS

| | | | | |
|---|---|---|---|---|
| 5,430,423 | A | 7/1995 | Herd | |
| 5,522,226 | A | 6/1996 | Mruzek | |
| 5,934,082 | A | 8/1999 | Steinmeyer | |
| 6,164,077 | A | 12/2000 | Feger | |
| 6,193,225 | B1 * | 2/2001 | Watanabe | F16F 1/043 267/167 |
| 6,438,967 | B1 * | 8/2002 | Sarwinski | F25D 19/006 165/185 |
| 7,287,387 | B2 | 10/2007 | Kirichek | |
| 8,069,675 | B2 | 12/2011 | Radovinsky | |
| 2007/0074522 | A1 | 4/2007 | Kim | |
| 2007/0089432 | A1 * | 4/2007 | Boesel | F25D 19/006 62/51.1 |
| 2008/0271467 | A1 | 11/2008 | Gilgrass | |
| 2011/0025326 | A1 * | 2/2011 | Zens | G01R 33/302 324/307 |

* cited by examiner

AUTOMATIC THERMAL DECOUPLING OF A COLD HEAD

This application claims Paris convention priority from DE 10 2014 218 773.7 filed Sep. 18, 2014, the entire disclosure of which is hereby incorporated by reference.

BACKGROUND OF THE INVENTION

The invention concerns a cryostat comprising a vacuum container which houses a chamber with at least one object to be cooled, wherein the vacuum container has at least one hollow neck tube which connects the chamber through the outer shell of the vacuum container to the area outside of the cryostat, wherein the neck tube houses a cooling arm of a cold head, wherein the cooling arm is thermally connected to a refrigeration device and can also be brought into thermal contact with a second thermal contact surface on the object to be cooled via a first thermal contact surface on the cooling arm.

A cryostat of this type is disclosed e.g. in U.S. Pat. No. 5,934,082 or U.S. Pat. No. 4,535,595.

In most cases, cryotechnology utilizes cooling machines for cooling objects, e.g. superconducting magnet coils. The cooling machines discharge heat from the apparatus containing the object to be cooled by means of a cold head.

These cooling machines are typically operated with helium gas as the coolant which is compressed in a compressor and expands in the cold head of the cryostat (e.g. so-called "pulse tube coolers"). The cold head and the compressor are generally connected to each other via two pressure lines. The cold head is connected to the components to be cooled either directly mechanically or via a contact medium (e.g. cryo gas or cryo liquid) or in both ways in order to ensure good heat transfer.

However, if, e.g. due to a technical defect or power failure, the compressor fails completely or partially, the previously cooled components are heated. In this situation, the cold head of the cryostat then represents a substantial thermal bridge between the components to be cooled and the external surroundings.

In its persistent operating mode, the superconducting current in a superconducting magnet can flow practically without resistance for extremely long time periods. However, heating of the magnet causes a so-called quench of the persistent operating mode after a certain time. At some point, the magnet reaches the critical transition temperature which is predetermined by the superconducting material and becomes normally conducting and thereby loses, generally abruptly, its high magnetic field.

A reduction of the thermal load after failure of the cooling machine would at least considerably extend the time period until a quench happens. This is true, in particular, for cryostat configurations that can be operated completely without or merely with minimum amounts of liquid coolant, wherein superconducting magnets are currently normally operated in a liquid helium bath.

U.S. Pat. No. 6,164,077 discloses replacement of the thermal contact between the cooling arm and the object being cooled with gas in the event of failure of the cooling device.

Since helium is becoming more and more expensive, cryostats that can be operated completely without or at least with minimum amounts of helium (low-loss or even cryo-free systems) are becoming more and more attractive both technically and economically.

However, the thermal capacity of solids significantly decreases at very low temperatures. For this reason, it would be particularly important for systems of this type using little amounts of liquid helium or no liquid helium at all to minimize the heat input into the object to be cooled in case of failure of the cooling unit.

U.S. Pat. No. 7,287,387 B2 describes a cooling unit for cooling a superconducting magnet coil and the radiation shields or chambers that surround it. Whereas cooling of the radiation shields or chambers is effected via direct thermal contact, the coil is cooled by means of re-liquefied helium. Bellows are used at the interface between the housing and the cooling unit in order to obtain vibrational decoupling. The cooling unit always remains in fixed contact with the radiation shield and the inner chamber. A pressure change in the inside of the cryostat does not change the thermal contact. It is only stated that the bellows should withstand an overpressure of 1 bar.

U.S. Pat. No. 8,069,675 B2 also describes a cold head that is flexibly connected to the cryostat. In this case, however, an actuator is operated in order to release the thermal contact. It is not an automatically functioning passive system but requires active intervention by an operator. The same also applies for the cooling configurations as disclosed e.g. in U.S. Pat. No. 5,522,226 or U.S. Pat. No. 5,430,423.

EP 0 366 818 A1 discloses a configuration with which the adjustment of the penetration depth of a cold head into a LN bath is done automatically in dependence on the pressure within the cryostat.

The above-cited U.S. Pat. No. 5,934,082 discloses a "cryo-free system", wherein the cold head is in thermally conducting physical contact both with a heat shield and a magnet coil. The hollow space between the heat shield and the cold head is evacuated in this connection. Spring elements are provided in the cooling device for absorbing or damping oscillations.

U.S. Pat. No. 4,535,595 also describes a similar cooling system. Also in this case, the gas is not in direct contact with the cold head but the hollow space is again evacuated. This document moreover discloses a cold head that can be displaced in a vertical direction and is also in thermal contact with a heat shield and a magnet coil.

In contrast thereto, it is the underlying object of the invention, which is relatively demanding and complex when regarded in detail, to significantly and operationally safely reduce the thermal load by the cold head onto the object to be cooled in case of failure of the cooling machine in a cryostat of the above-mentioned type with simple technical means and fully automatically without requiring the intervention of an operator, wherein already existing devices can be retrofitted with as simple means as possible.

SUMMARY OF THE INVENTION

This object is achieved by the present invention in a likewise surprisingly simple and effective fashion in that the hollow volume between the inner side of the hollow neck tube, the cooling arm that is disposed at least partially in the hollow neck tube, and the object to be cooled is at least partially filled with a gas or gas mixture with positive thermal expansion coefficient, wherein the internal pressure of the gas or gas mixture pressurizes part of the cooling arm, whereas another part of the cooling arm is directly or indirectly pressurized by atmospheric pressure, that the cooling arm is mounted in such a fashion that it can be moved within the hollow neck tube by a length of at least 5 mm with its first thermal contact surface towards or away from the second thermal contact surface, and that a contact device brings or keeps the first thermal contact surface of the cooling arm in thermal contact with the second thermal contact surface on the object to be cooled when the gas or gas mixture pressure is below a predetermined low threshold pressure, whereas the contact device moves the first thermal contact surface of the cooling arm away from the second thermal contact surface of the object to be cooled when the gas or gas mixture pressure has reached or exceeded a threshold pressure, such that the thermal contact surfaces no longer contact each other in this position but are thermally separated from each other by a gap filled with gas or a gas mixture.

In case of gas mediated contact between the two contact surfaces, the mutual separation between the contact surfaces is of considerable importance for the heat transfer. In the inventive configuration, the cooling arm of the cold head is moved by the gas that expands due to heating in such a fashion that the thermal contact between the two contact surfaces is cancelled in that a gas gap is formed between the contact surfaces which increases, thereby substantially reducing the thermal input into the object to be cooled, generally a superconducting magnet. If the gap increases e.g. from 0.1 mm to 10 mm the heat input (without convection) is reduced by a factor of 100.

The reduced heat input considerably increases the time period until the magnet coil reaches its critical temperature during a quench and becomes normally conducting. This time period is an essential specification of superconducting magnets.

The contact between the cooling arm and a heat shield is also reduced by the movement and the heat input into the shield is therefore also reduced in this case. The shield is therefore heated considerably more slowly after failure of the cold head. The shield temperature is of considerable importance for any other heat input into the object to be cooled, in particular a magnet coil. Slower heating of the shield therefore automatically results in slower heating of the superconducting magnet coil, thereby extending the time period before a quench happens.

The movement that forms and increases the gap is made possible in that the cooling arm (or in variants of the invention also the entire cold head) is mounted to be movable along its axis.

There are, in principle, substantially three feasible different variants of providing thermal contact in order to ensure good thermally conducting contact between the first thermal contact surface of the cooling arm and the second thermal contact surface on the object to be cooled in an operating state below the predetermined threshold pressure of the gas or gas mixture:

1. Direct thermal contact without liquid helium: In this case a liquid helium bath is completely omitted and the two contact surfaces are in tight thermally conducting physical contact in this operating state.

2. Direct thermal contact with liquid helium: The same tight physical contact between the two contact surfaces in the operating state below the predetermined threshold pressure can also be established when the two contact surfaces are located in a liquid helium bath which further increases the thermally conducting contact at least in the edge regions.

3. Indirect thermal contact with liquid helium: In this variant, the two contact surfaces are indeed physically separated in the operating state below the predetermined threshold pressure but are located in a common liquid helium bath which ensures a good thermally conducting thermal connection between the two contact surfaces in this operating state.

In one particularly preferred embodiment of the inventive cryostat, the contact device comprises a bellows and/or a diaphragm and/or a radial seal by means of which the cooling arm is mounted in the hollow neck tube such that it can be displaced in a linear direction along its axis.

In one further advantageous embodiment of the invention, the contact device has a stop surface against which the counter surface of the cooling arm in the hollow neck tube, which is rigidly connected to the cooling arm, can abut during linear displacement along its axis towards the object to be cooled, wherein the relative positions of the surfaces are selected such that in case of mechanical contact between the stop surface and the counter surface, the first thermal contact surface of the cooling arm also comes into thermally conducting contact with the second thermal contact surface on the object to be cooled. This stop may also be adjustable in order to optimally reduce the gap between the contact surfaces. Mechanical decoupling is required to prevent transfer of detrimental vibrations from the cooling arm to the object to be cooled, in particular a superconducting magnet coil.

Without further measures, the movement would take place only when the atmospheric pressure is exceeded. For this reason, in one preferred embodiment of the inventive cryostat, the contact device has a pretensioning device that generates an additional force in addition to the pressure of the gas or gas mixture acting on the cooling arm, which additional force acts in a direction of movement of the cooling arm during linear displacement in the hollow neck tube along its axis in a direction away from the object to be cooled. The motion pressure acting on the displaceable cooling arm can thereby be reduced.

In one advantageous further development of this embodiment, the additional force on the cooling arm generated by the pretensioning device has a non-linear characteristic that depends on the path of displacement of the cooling arm due to the acting pressure of the gas or gas mixture, wherein the additional force becomes sufficiently large that the first thermal contact surface of the cooling arm is lifted off the second thermal contact surface on the object to be cooled only when a predetermined threshold pressure of the gas or gas mixture is exceeded, such that a gap separates the contact surfaces and that, even when the pressure of the gas or gas mixtures only slightly further increases, this gap quickly increases due to the additional force that acts on the cooling arm. This is advantageous in that the cooling arm is already decoupled shortly after failure of the cold head. A typical operating pressure is e.g. 200 mbar. Reaching atmospheric pressure would take a long time during which the cooling arm would transfer heat to the object to be cooled, in particular a superconducting magnet coil, due to its thermal coupling.

In particularly simple further developments of this embodiment, the pretensioning device comprises one or more pretensioning springs. These springs generate the specified pretensioning force and at the same time enable vibrational decoupling of the cooling arm from the outer shell of the object to be cooled, in particular a superconducting magnet coil.

In particularly preferred variants, the additional force exerted by the pretensioning springs on the cooling arm can be mechanically adjusted, in particular by means of one or more adjustment screws. In this fashion, the pretensioning force can be adjusted to the generated operating pressure. All cold head/cooling object combinations slightly differ from each other. For this reason, it is extremely reasonable to make the pretensioning force adjustable.

In further advantageous embodiments of the inventive cryostat, the cooling arm is mounted in such a fashion and the contact device is designed in such a fashion that the first thermal contact surface of the cooling arm inside the hollow neck tube can be moved by a length of at least 10 mm, preferably at least 20 mm, in particular at least 50 mm, towards or away from the second thermal contact surface on the object to be cooled. The thermal conduction between the contact surfaces can therefore be reduced by a factor of up to 500.

In other advantageous embodiments, the first thermal contact surface of the cooling arm is located completely or partially in liquid helium in an operating state below the predetermined threshold pressure of the gas or gas mixture and when the threshold pressure has been exceeded, it emerges from the helium bath into the surrounding gas or gas mixture due to the movement away from the second thermal contact surface of the object to be cooled. In this connection, the thermal contact between the contact surfaces in this operating state can either be provided through direct physical contact between the two contact surfaces and/or indirectly by means of the liquid helium with its excellent heat conducting properties. Liquid helium substantially represents a perfect heat bridge. Only a tiny temperature gradient will form in the helium due to convection. As soon as the cold head fails, it transfers its heat directly into the liquid helium and thus to the object to be cooled, in particular a superconducting magnet coil. When the contact surface emerges from the helium, heat is transferred only by gas, thereby considerably reducing the transfer of heat.

In one alternative embodiment, there is no liquid helium bath and the first thermal contact surface of the cooling arm is in direct physical, and therefore thermally conducting, contact with the second thermal contact surface of the object to be cooled in the operating state below the predetermined threshold pressure of the gas or gas mixture. When the threshold pressure has been exceeded, the contact surfaces are moved apart, thereby generating a thermally insulating gas gap between the two contact surfaces.

In another advantageous embodiment of the inventive cryostat, the chamber containing the object to be cooled is surrounded by a radiation shield inside the vacuum container. This considerably reduces the thermal load due to radiation and thermal conduction.

In one class of preferred embodiments, a superconducting magnet coil is arranged in the chamber as an object to be cooled. Magnet systems of this type usually consist of a magnet coil, a radiation shield, a vacuum container and one or more neck tubes that connect the magnet coil or mounting parts to the outer shell.

The present invention also concerns a magnetic resonance configuration comprising a superconducting magnet coil, in particular an NMR spectrometer configuration or an NMR tomography configuration but also an MRI or FTMS apparatus, each comprising an inventive cryostat as described above. The present invention protects the superconducting magnet coil of the magnetic resonance configuration particularly well against a quench of the persistent operating mode and is therefore particularly well suited for high-resolution measurements. A magnetic resonance configuration of this type typically comprises at least one magnet that is generally superconducting and is arranged in a cryostat, and also radio frequency components, e.g. RF coils in a room temperature bore of the cryostat and a sample position for a sample to be measured. "Normal" conventional high field NMR spectrometers operate at a proton resonance frequency of between approximately 200 MHz and 500 MHz. In contrast thereto, a high field NMR spectrometer with ultra-high resolution can be operated nowadays at proton resonance frequencies ≥800 MHz.

Further advantages of the invention can be extracted from the description and the drawing. In accordance with the invention, the features mentioned above and below may be used individually or collectively in arbitrary combination. The embodiments shown and described are not to be understood as exhaustive enumeration, rather have exemplary character for describing the invention.

The invention is illustrated in the drawing and is explained in more detail with reference to embodiments.

DESCRIPTION OF THE PREFERRED EMBODIMENT

Figure 1B:
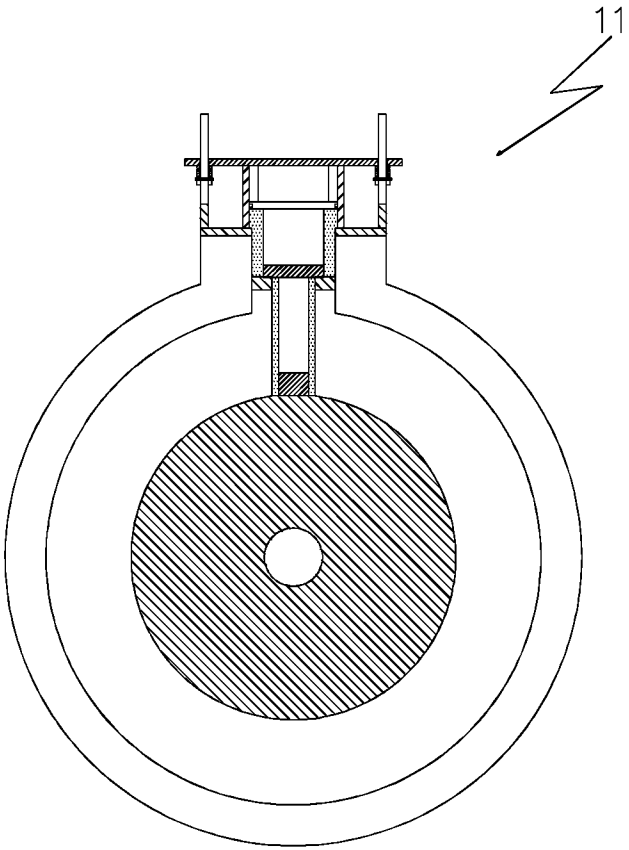
FIG. 1*b* shows the configuration of FIG. 1*a* is but with physical and thermal contact between the cooling arm and the magnet.

FIGS. 1*a*, 1*b*, 2*a* and 2*b* each show a schematic vertical section of embodiments of the inventive cryostat 11; 11'; 11"; 11''' comprising a vacuum container 9 which houses a chamber 12 containing at least one object 4 to be cooled (in particular a superconducting magnet coil in an NMR, MRI or FTMS apparatus), wherein the vacuum container 9 is provided with at least one hollow neck tube 10 which connects the chamber 12 through the outer shell of the vacuum container 9 to the area outside of the cryostat 11; 11'; 11"; 11''', wherein the neck tube 10 comprises a cooling arm 1*a*; 1*a'*; 1*a"*; 1*a'''* of a cold head 1 which is thermally connected to a refrigeration device and can also be brought into thermal contact with a second thermal contact surface 3*b*; 3*b'*; 3*b"* on the object 4 to be cooled via a first thermal contact surface 3*a*; 3*a'*; 3*a"* on the cooling arm 1*a*; 1*a'*; 1*a"*; 1*a'''*.

The chamber 12 containing the object 4 to be cooled is surrounded by a radiation shield 5 inside the vacuum container 9.

The inventive cryostat 11; 11'; 11"; 11''' is characterized in that the hollow volume 2; 2'; 2" between the inner side of the hollow neck tube 10, the cooling arm 1*a*; 1*a'*; 1*a"*; 1*a'''* that is at least partially arranged therein, and the object 4 to be cooled is filled at last in part with a gas or a gas mixture with positive thermal expansion coefficient, wherein the inner pressure of the gas or gas mixture pressurizes part of the cooling arm 1*a*; 1*a*'; 1*a*"; 1*a*'", whereas another part of the cooling arm 1*a*; 1*a*'; 1*a*"; 1*a*'" is directly or indirectly pressurized by atmospheric pressure, that the cooling arm 1*a*; 1*a*'; 1*a*"; 1*a*'" is mounted in such a fashion that it can be moved within the hollow neck tube 10 by a length of at least 5 mm with its first thermal contact surface 3*a*; 3*a*'; 3*a*"; 3*a*'" towards or away from the second thermal contact surface 3*b*; 3*b*'; 3*b*", and that a contact device is provided which brings or keeps the first thermal contact surface 3*a*; 3*a*'; 3*a*" of the cooling arm 1*a*; 1*a*'; 1*a*"; 1*a*'" in thermal contact with the second thermal contact surface 3*b*; 3*b*'; 3*b*" on the object 4 to be cooled when the pressure of the gas or gas mixture is below a predetermined low threshold pressure, while the contact device moves the first thermal contact surface 3*a*; 3*a*'; 3*a*" of the cooling arm 1*a*; 1*a*'; 1*a*"; 1*a*'" away from the second thermal contact surface 3*b*; 3*b*'; 3*b*" of the object 4 to be cooled when the pressure in the gas or gas mixture has reached or exceeded the threshold pressure such that in this position, a gap 13 filled with gas or gas mixture thermally separates the contact surfaces 3*a*, 3*b*; 3*a*', 3*b*'; 3*a*", 3*b*".

The cooling arm 1*a*; 1*a*'; 1*a*"; 1*a*'" is advantageously mounted in such a fashion and the contact device is designed in such a fashion that the first thermal contact surface 3*a*; 3*a*'; 3*a*" of the cooling arm 1*a*; 1*a*'; 1*a*"; 1*a*'" can be moved within the hollow neck tube 10 by a length of at least 10 mm, preferably at least 20 mm, in particular at least 50 mm towards or away from the second thermal contact surface 3*b*; 3*b*'; 3*b*" on the object 4 to be cooled.

The contact device may comprise a bellows and/or a diaphragm and/or, as illustrated in the figures of the drawing, a radial seal 6 by means of which the cooling arm 1*a*; 1*a*'; 1*a*" is mounted in the hollow neck tube 10 in such a fashion that it can be displaced in a linear direction along its axis.

The contact device has a stop surface 14*a* against which the cooling arm 1*a*; 1*a*'; 1*a*"; 1*a*'" in the hollow neck tube 10 can abut with its counter surface 14*b* that is rigidly connected to the cooling arm 1*a*; 1*a*'; 1*a*"; 1*a*'" during linear displacement along its axis in the direction towards the object 4 to be cooled, wherein the relative positions of the surfaces are selected such that in case of mechanical contact between the stop surface 14*a* and the counter surface 14*b*, the first thermal contact surface 3*a*; 3*a*'; 3*a*" of the cooling arm 1*a*; 1*a*'; 1*a*"; 1*a*'" also comes into thermally conducting contact with the second thermal contact surface 3*b*; 3*b*'; 3*b*" on the object 4 to be cooled.

The contact device moreover comprises a pretensioning device which generates an additional force in addition to the pressure of the gas or gas mixture acting on the cooling arm 1*a*; 1*a*'; 1*a*"; 1*a*'", which additional force acts in a direction of movement of the cooling arm 1*a*; 1*a*'; 1*a*"; 1*a*'" during linear displacement in the hollow neck tube 10 along its axis in a direction away from the object 4 to be cooled. The pretensioning device comprises one or more pretensioning springs 7, wherein the additional force that the pretensioning springs 7 exert on the cooling arm 1*a*; 1*a*'; 1*a*"; 1*a*'" can be mechanically adjusted by means of one or more adjustment screws 8.

Figure 1A:
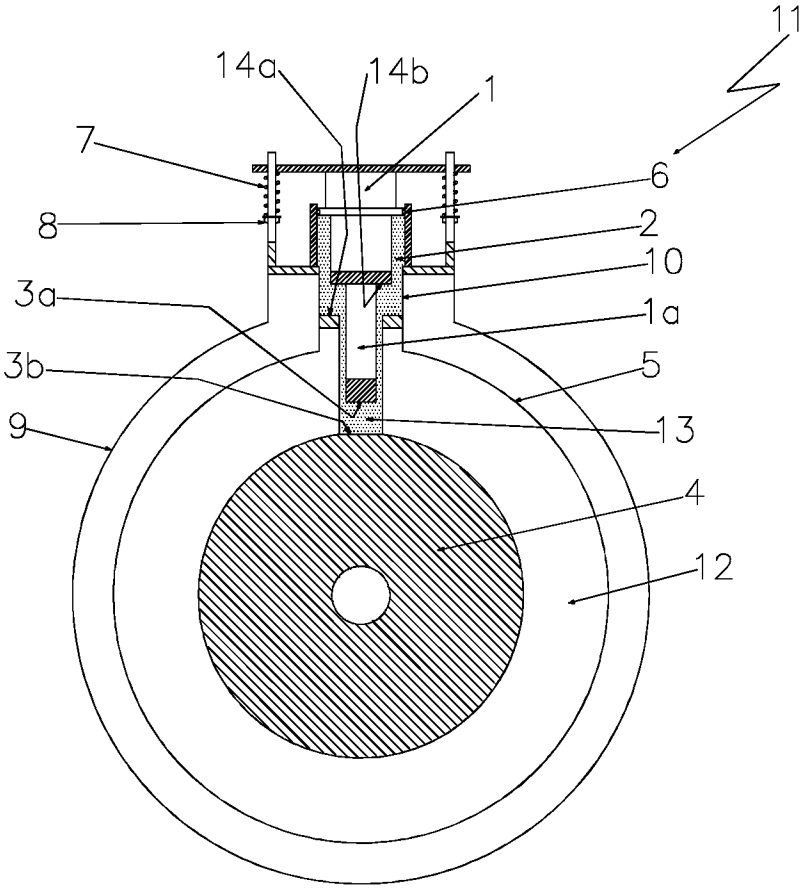
FIG. 1*a* shows a schematic vertical sectional view of an embodiment of an inventive cryostat of an NMR spectrometer, wherein the cooling arm of the cold head is spatially and therefore also thermally separated from the NMR magnet.

In the embodiment of the inventive cryostat 11 illustrated in FIGS. 1*a* and 1*b*, the overall hollow volume 2 comprises only gas or a gas mixture but no liquid.

Thermal decoupling between the cooling arm is and the object 4 to be cooled is achieved by generating the gas-filled gap 13 due to the gas pressure-driven movement of the cooling arm is when the predetermined threshold pressure has been reached or exceeded by heating of the gas or gas mixture. This operating state is illustrated in FIG. 1*a*.

In contrast thereto, FIG. 1*b* shows an operating state of the cryostat 11 below the threshold pressure, in which the first thermal contact surface 3*a* of the cooling arm 1*a* is in direct physical and therefore also thermal contact with the second thermal contact surface 3*b* on the object 4 to be cooled.

Figure 2B:
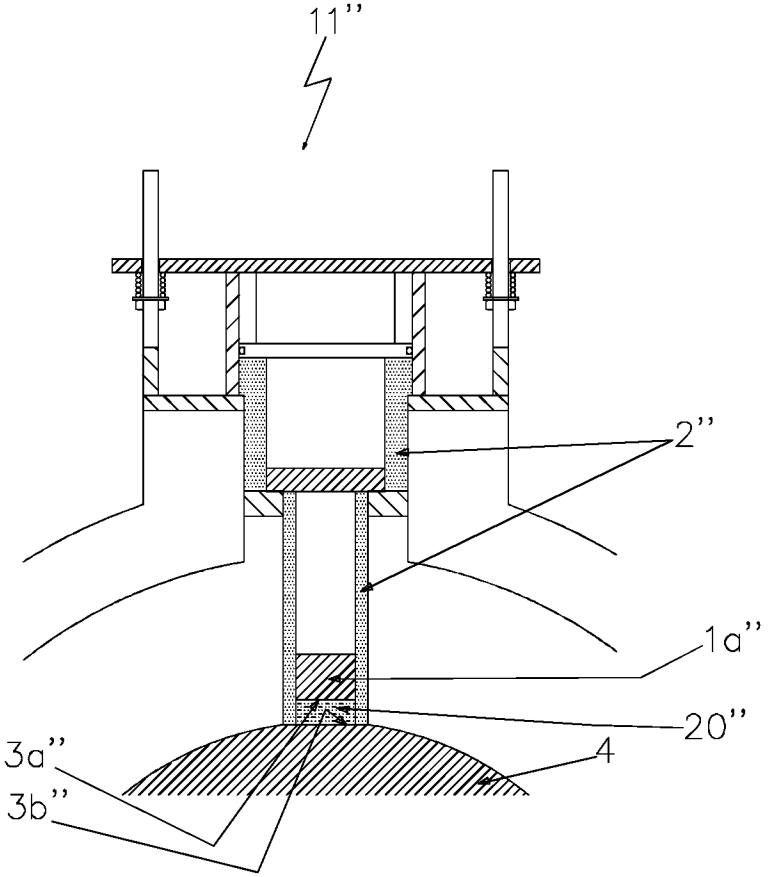
FIG. 2*b* shows a configuration as in FIG. 2*b*, wherein, however, the cooling arm is not in physical contact with the object to be cooled but the first contact surface is thermally connected to the second contact surface via a liquid helium bath.
Figure 2A:
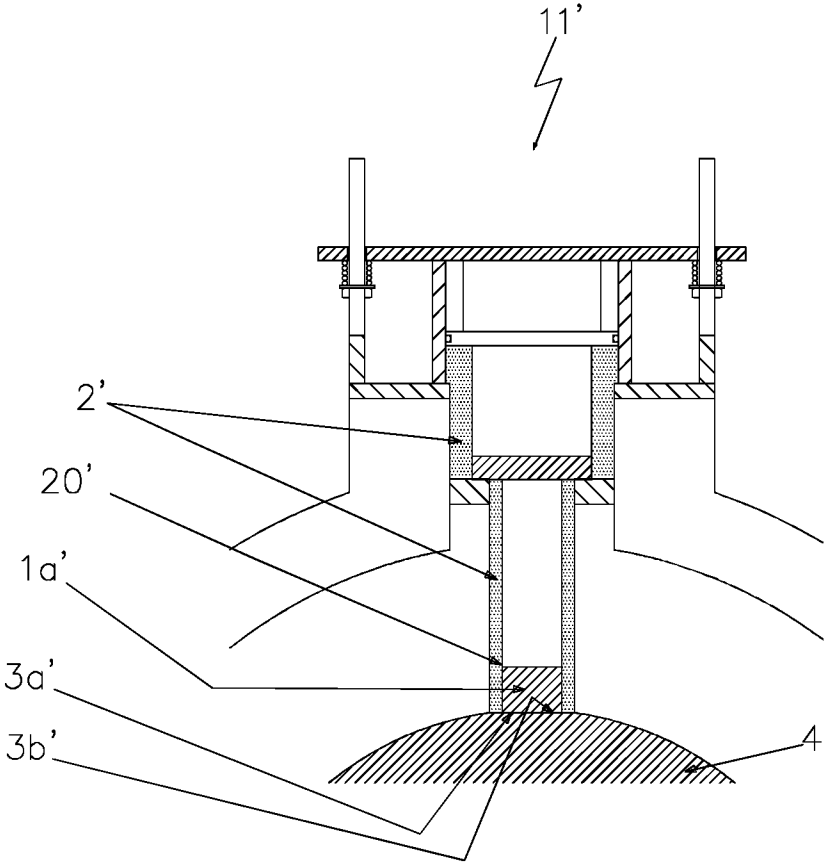
FIG. 2*a* shows a schematic vertical sectional view of a further embodiment with physical and thermal contact between the cooling arm and the object to be cooled, wherein the cooling arm is located in the area of its first thermal contact surface in a liquid helium bath.

The embodiments of the inventive cryostat 11'; 11" illustrated in FIGS. 2*a* and 2*b* are characterized in that the first thermal contact surface 3*a*', 3*a*" of the cooling arm 1*a*'; 1*a*" is located completely or partially in liquid helium in an operating state below the predetermined threshold pressure of the gas or gas mixture and when the threshold pressure has been exceeded, it emerges from the helium bath 20'; 20" into the surrounding gas or gas mixture hollow volume 2'; 2" due to the movement away from the second thermal contact surface 3*b*'; 3*b*" of the object 4 to be cooled.

In the embodiment illustrated in FIG. 2*a*, the first thermal contact surface 3*a*' of the part of the cooling arm 1*a*' that is immersed into the helium bath 20' in the operating state below the predetermined threshold pressure of the gas or gas mixture is in physical contact with the second thermal contact surface 3*b*' on the object 4 to be cooled.

FIG. 2*b*, however, shows an embodiment of the invention in which the cooling arm 1*a*" is not in physical contact with the object 4 to be cooled even in an operating state below the threshold pressure but the first contact surface 3*a*" is thermally connected to the second contact surface 3*b*" via the helium bath 20".

When the predetermined threshold value has been reached or exceeded through heating of the gas or gas mixture and the accompanying increase in inner pressure, the cooling arms 1*a*'; 1*a*" of the embodiments of FIGS. 2*a* and 2*b* are each caused to move away from the object 4 to be cooled. The contact devices of these embodiments are designed such that the first thermal contact surface 3*a*'; 3*a*" of the cooling arm 1*a*'; 1*a*" emerges from the helium bath 20'; 20" in such an operating state and a gap is again formed towards the second thermal contact surface 3*b*'; 3*b*" on the object 4 to be cooled which is filled with thermally insulating gas or gas mixture.

Figure 3:
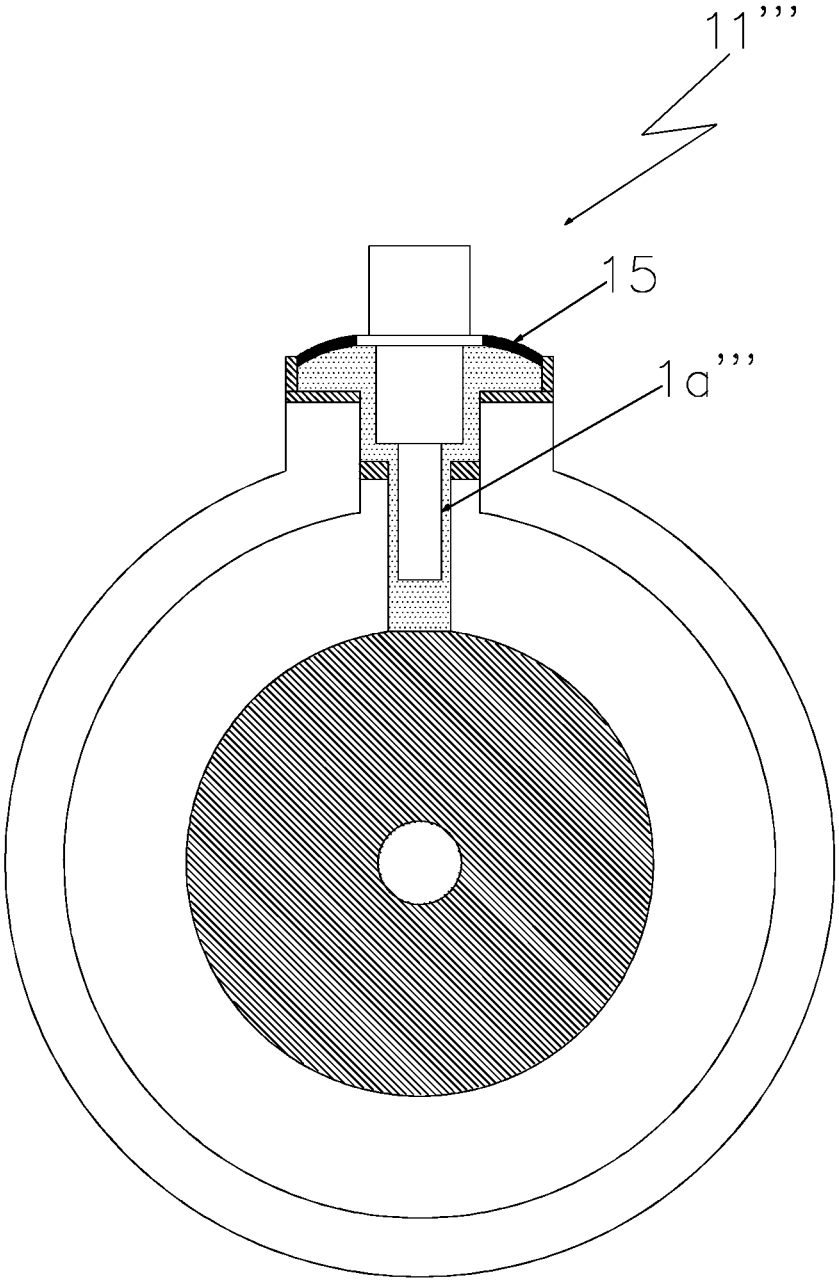
FIG. 3 shows an embodiment of the inventive cryostat, in which the mechanical element that connects the cooling arm of the cold head in a flexible fashion to the neck tube of the cryostat, is designed as a vacuum-proof diaphragm.

In the embodiment of the inventive cryostat 11'" illustrated in FIG. 3, the contact device comprises a vacuum-proof diaphragm 15 by means of which the cooling arm 1*a*'" is mounted in the hollow neck tube 10 such that it can be displaced in a linear direction along its axis.

I claim:

1. A cryostat comprising:

a vacuum container having an outer shell, said vacuum container also having a chamber and at least one hollow neck tube which connects said chamber through said outer shell to a region outside of the cryostat;

a cooling arm with a cold head disposed on a distal end of said cooling arm, said cold head having a first thermal contact surface;

at least one object to be cooled, wherein said object to be cooled is disposed in said chamber, said object to be cooled having a second thermal contact surface;

a contact device disposed on a proximal end of said cooling arm, wherein said cooling arm is at least partially disposed in said neck tube, said cooling arm being thermally connected to a refrigeration device, wherein said cooling arm is structured to be brought into thermal contact with said second thermal contact surface of said object via said first thermal contact surface of said cold head using said contact device; and a gas or gas mixture having internal pressure and a positive thermal expansion coefficient, said gas or gas mixture at least partially filling a hollow volume between an inner side of said hollow neck tube, said cooling arm and said object to be cooled, wherein said internal pressure of said gas or gas mixture surrounds part of said cooling arm, said contact device being surrounded by atmosphere having atmosphere pressure, wherein said cooling arm is disposed, structured, mounted and dimensioned for movement of said first thermal contact surface of said cold head within said hollow neck tube through a length of at least 5 mm towards and away from said second thermal contact surface of said object, said contact device being structured to bring or keep said first thermal contact surface of said cold head in thermal contact with said second thermal contact surface on said object to be cooled when said gas or gas mixture pressure is below a pre-determined low threshold pressure and said contact device moving said first thermal contact surface of said cold head away from said second thermal contact surface of said object to be cooled when said gas or gas mixture pressure has reached or exceeded a threshold pressure, thereby creating a gap filled with said gas or gas mixture, said gap thermally separating said first thermal contact surface of said cold head from said second thermal contact surface of said object, wherein said first thermal contact surface of said cold head is located completely or partially in liquid helium in an operating state below said pre-determined threshold pressure of said gas or gas mixture and, when said threshold pressure has been exceeded, said cooling arm emerges from said liquid helium into said surrounding gas or gas mixture due to movement of said first thermal contact surface of said cold head away from said second thermal contact surface of said object to be cooled.

2. The cryostat of claim 1, wherein said contact device comprises a bellows, a diaphragm and/or a radial seal by means of which said cooling arm is mounted in said hollow neck tube such that said cooling arm can be displaced in a linear direction along an axis thereof.

3. The cryostat of claim 1, wherein said contact device has a stop surface against which a counter surface of said cooling arm abuts during linear displacement along an axis thereof towards said object to be cooled, said counter surface being rigidly connected to said cooling arm, wherein relative positions of said stop surface and said counter surface are selected such that said first thermal contact surface of said cold head comes into thermally conducting contact with said second thermal contact surface on said object to be cooled when mechanical contact is obtained between said stop surface and said counter surface.

4. The cryostat of claim 1, wherein said contact device comprises a pretensioning device that generates an additional force acting on said cooling arm together with said pressure of said gas or gas mixture, said additional force thereby acting in a direction of movement of said cooling arm during linear displacement in said hollow neck tube along an axis thereof in a direction away from said object to be cooled.

5. The cryostat of claim 4, wherein said additional force on said cooling arm generated by said pretensioning device depends on a path of displacement of said cooling arm due to acting pressure of said gas or gas mixture, wherein said additional force becomes sufficiently large so that said first thermal contact surface of said cold head is lifted off said second thermal contact surface on said object to be cooled only when a predetermined threshold pressure of said gas or gas mixture is exceeded such that said gap filled with said gas or a gas mixture separates said first and said second thermal contact surfaces, wherein said gap quickly increases due to said additional force that acts on said cooling arm even when said pressure of said gas or gas mixture only slightly further increases.

6. The cryostat of claim 4, wherein said pretensioning device comprises one or more pretensioning springs generating said additional force.

7. The cryostat of claim 6, wherein said additional force exerted by said pretensioning springs on said cooling arm can be mechanically adjusted.

8. The cryostat of claim 1, wherein said cooling arm is mounted and said contact device is designed in such a fashion that said first thermal contact surface of said cold head inside said hollow neck tube can be moved by a length of at least 10 mm towards or away from said second thermal contact surface on said object to be cooled.

9. The cryostat of claim 1, wherein said chamber containing said object to be cooled is surrounded by a radiation shield inside said vacuum container.

10. The cryostat of claim 1, wherein a superconducting magnet coil is arranged in said chamber as said object to be cooled and said cryostat together with said superconducting magnet coil are part of an NMR, MRI or FTMS apparatus.

11. The cryostat of claim 10, wherein said NMR, MRI or FTMS apparatus comprises a high-resolution high field NMR spectrometer with a proton resonance frequency of between 200 MHz and 500 MHz.

* * * * *